US006665951B1

(12) United States Patent
Kuhl

(10) Patent No.: US 6,665,951 B1
(45) Date of Patent: Dec. 23, 2003

(54) METHOD AND APPARATUS FOR DRYING A STACK OF FLATS

(76) Inventor: Jeffrey B. Kuhl, 61 Kuhl Rd., Flemington, NJ (US) 08822

( * ) Notice: Subject to any disclaimer, the term of this patent is extended or adjusted under 35 U.S.C. 154(b) by 0 days.

(21) Appl. No.: 10/225,965

(22) Filed: Aug. 22, 2002

(51) Int. Cl.[7] ..... F26B 5/08

(52) U.S. Cl. ..... 34/312; 34/328; 34/317; 210/787

(58) Field of Search ..... 34/312, 328, 317, 34/318, 58, 85; 210/787, 512.1

(56) References Cited

U.S. PATENT DOCUMENTS

| | | | | |
|---|---|---|---|---|
| 2,609,100 | A | | 9/1952 | Vitale |
| 3,300,871 | A | | 1/1967 | O'Conor |
| 3,386,180 | A | | 6/1968 | Balz et al. |
| 3,998,656 | A | | 12/1976 | Grotto |
| 4,064,635 | A | | 12/1977 | Kuhl |
| 4,134,215 | A | | 1/1979 | Kuhl |
| 4,155,293 | A | | 5/1979 | Spiel et al. |
| 4,170,241 | A | | 10/1979 | Clapp |
| 4,173,830 | A | | 11/1979 | Hanson |
| 4,313,266 | A | * | 2/1982 | Tam ..... 34/317 |
| 4,637,146 | A | * | 1/1987 | Motoki et al. ..... 34/58 |
| 4,651,440 | A | | 3/1987 | Karl |
| 4,702,777 | A | | 10/1987 | Kuhl |
| 4,742,624 | A | * | 5/1988 | Grant ..... 34/58 |
| 5,067,192 | A | | 11/1991 | Guelfi et al. |
| 5,185,041 | A | | 2/1993 | Anderson et al. |
| 5,212,876 | A | | 5/1993 | Berit |
| 5,386,645 | A | * | 2/1995 | Park et al. ..... 34/317 |
| 5,802,733 | A | | 9/1998 | Hougham |
| 6,298,575 | B1 | | 10/2001 | Aikins et al. |
| 6,503,335 | B2 | * | 1/2003 | Hohl et al. ..... 134/33 |
| 2002/0033550 | A1 | | 3/2002 | Suehara |

* cited by examiner

*Primary Examiner*—Ira S. Lazarus
*Assistant Examiner*—Kathryn S. O'Malley
(74) *Attorney, Agent, or Firm*—Sperry, Zoda & Kane

(57) ABSTRACT

Spin drying of a stack of flats such as egg trays is performed within a housing by movement of a rotatable lifting head into engagement with the undersurface of the stack. A stack lifting device lifts the lifting head and the stack of flats positioned thereon vertically upwardly into engagement with a drive engagement device thereabove which is rotatably powered by a drive with an optional braking device. Operation of the drive will cause rotation of the lifting head, the stack of flats and the drive engagement device simultaneously. The stack of flats will be held between the lifting head engaging the lower surface thereof and the drive engagement device engaging the upper surface thereof for fixedly securing these three elements together during powered rotation thereof. The rotation will spin off any liquids remaining on the flats such as would be present after being washed. The stack of flats are transported into the spin dry housing and exited therefrom by a conveyor moving at the base level through the spin drying housing. Registration between the stack and the drive engagement device is facilitated by a registering device for affixing these two members together rotationally.

15 Claims, 2 Drawing Sheets

METHOD AND APPARATUS FOR DRYING A STACK OF FLATS

BACKGROUND OF THE INVENTION

1. Field of the Invention

The present invention deals with the field of devices for drying articles, particularly hydrophobic articles such as plastic flats or egg carrying trays. The present invention provides a means for drying of these flats which will most likely occur immediately after washing thereof which is a spin drying operation for centrifugally spinning the water or other cleansing solution thereof by high speed rotation of a stack of wet flats.

There are other means of drying such flats such as high speed air blowers or heated airstreams, however, spin drying has significant advantages in speed and in drying efficiency.

2. Description of the Prior Art

Many prior art devices have been utilized for the washing and drying of trays and egg carrying flats and other configurations have been utilized for spin drying of various articles such as shown in U.S. Pat. No. 2,609,100 patented Sep. 2, 1952 to S. L. Vitale on a "Drying Machine Having Centrifugal Units"; and U.S. Pat. No. 3,300,871 patented Jan. 31, 1967 to F. O'Conor and assigned to Ametek, INc. on a "Centrifugal With Cover And Brake Assembly"; and U.S. Pat. No. 3,386,180 patented Jun. 4, 1968 to G. W. Balz et al and assigned to Roto-Finish Company on a "Continuous Centrifugal Device"; and U.S. Pat. No. 3,998,656 patented Dec. 21, 1976 to L. P. Grotto on a "Method And Apparatus For Cleaning Cylindrical Air Filters"; and U.S. Pat. No. 4,064,635 patented Dec. 27, 1977 to H. Y. Kuhl on an "Apparatus For Drying Plastic Trays"; and U.S. Pat. No. 4,134,215 patented Jan. 16, 1979 to H. Y. Kuhl on a "Process For Drying Hydrophobic Articles"; and U.S. Pat. No. 4,155,293 patented May 22, 1979 to A. Spiel et al and assigned to Nabisco, Inc. on a "Continuous Cooking Apparatus And Process"; and U.S. Pat. No. 4,170,241 patented Oct. 9, 1979 to J. W. M. Clapp and assigned to Thermoplastic Compounders Limited on an "Apparatus For Cleaning Containers"; and U.S. Pat. No. 4,173,830 patented Nov. 13, 1979 to D. R. Hanson on a "Dryer For Mesh Baskets"; and U.S. Pat. No. 4,651,440 patented Mar. 24, 1987 to G. M. Karl and assigned to Eastman Kodak Company on a "Spin Drying Apparatus"; and U.S. Pat. No. 4,702,777 patented Oct. 27, 1987 to H. Y. Kuhl on a "Method And Apparatus For High Capacity Washing, Sanitizing And Drying Of Stacks Of Flats"; and U.S. Pat. No. 5,067,192 patented Nov. 26, 1991 to F. Guelfi et al and assigned to Colged S.p.A. on an "Automatic Machine For Washing Self-Service Trays And Similar Items"; and U.S. Pat. No. 5,185,041 patented Feb. 9, 1993 to R. M. Anderson et al on a "Machine For Washing Plastic Fragments To Prepare Them For Recycling"; and U.S. Pat. No. 5,212,876 patented May 25, 1993 to B. I. Berit and assigned to Sanborn, Inc. on an "Automatic Spin Dryer"; and U.S. Pat. No. 5,802,733 patented Sep. 8, 1998 to J. Hougham and assigned to The Great Norther Equipment Company on a "Dryer System For Vegetables"; and U.S. Pat. No. 6,298,575 patented Oct. 9, 2001 to J. E. Aikins et al on a "Passive Spin Dryer For Continuous And Batch Processing"; and U.S. Pat. No. Publication No. US 2002/0033550 A1 published Mar. 21, 2002 to K. Suehara on a "Method For Recycling Used-Up Plastic Products And Washing Process Of Crushed Plastic And Apparatus Therefor".

SUMMARY OF THE INVENTION

The present invention provides a unique apparatus for spin drying of a stack of flats including a housing which defines a base level therein at which level stacks of flats are transported for drying. The housing may also include a slotted wall extending circumferentially therearound to facilitate retaining of fluids expelled from the stack of trays during the spin drying operation itself. The slotted wall preferably is formed of a translucent material to facilitate observation of the operation of the apparatus for drying flats for monitoring and other reasons.

A lifting head is preferably included defined within the housing which is vertically movable to allow movement upwardly into contact with the undersurface of a stack of flats positioned thereabove at the base level to facilitate lifting thereof upwardly to a position above this base level. This higher position is referred to as the spin drying level. The lifting head is preferably movable rotatably relative to the housing about a lifting axis of rotation which extends vertically therewithin. The lifting head also includes a support plate preferably which is rotatably mounted therein and preferably includes a plurality of support pins extending vertically therefrom which are adapted to facilitate engagement of the support plate with respect to the undersurface of the stack of flats to facilitate retaining therein during upward movement.

A stack lifting device may be positioned within the housing at a location below the base level which is defined as the retracted position. This stack lifting device may preferably include an extensible pneumatic cylinder which urges movement of the lifting head upwardly into abutment with respect to the undersurface of a stack of flats at the base level for lifting thereof upwardly to the spin level for facilitating drying thereof when spun. The stack lifting device is preferably positionable at a retracted level below the base level within the housing in the normal steady state position. The stack lifting device is also preferably attached to the lifting head and is also vertically movable upwardly therewith to facilitate lifting of the head means into engagement with a stack of trays at the base level from beneath for lifting thereof vertically upward to a spin level for spin drying.

A drive engagement device is also preferably mounted within the housing at a position above a stack of flats positioned therein at the base level. This drive engagement device is mounted within the housing means to be rotatably movable therewith about a drive axis of rotation. This drive axis of rotation is preferably positioned below the lifting axis of rotation and is aligned vertically therewith to facilitate of the stack of flats during drying when engaged by the drive engagement device from above and the lifting means from below. Also the drive axis of rotation and the lifting axis of rotation are preferably oriented axially coincident with respect to one another.

The drive engagement device is adapted to engage a stack of flats from above responsive to movement of the stack of flats upwardly into abutting contact therewith in order to urge rotational movement of the stack of flats responsive to rotational movement of the drive engagement device. This device will include a spinner plate which is rotatable about the drive axis of rotation and is adapted to engage a stack of flats moved upwardly into contact therewith. The spinner plate preferably include a registration apparatus adapted to positively engage a stack of flats into contact therewith to provide simultaneous coordinated rotation of the stack of flats responsive to powered rotation of the drive engagement device. The registration apparatus will preferably include a plurality of alignment pins mounted in the spinner plate and extending downwardly therefrom to facilitate registration of the stack of flats with respect to the spinner plate for providing simultaneous rotational movement of the stack of flats responsive to powered rotation of the spinner plate. The alignment pins are preferably positioned in a pin array adapted to register with the stack of flats and cause same to rotate whenever the spinner plate is caused to rotate. The pin array preferably forms a rectangular profile to facilitate engaging of the corners of the stacks of the flats which are normally of rectangular shape.

A drive device is mounted within the housing above the stack of flats. The drive means is operatively attached to the drive plate for urging rotational movement thereof responsive to operation of the drive to spin dry a stack of flats held at the spin level between the drive engagement device in abutment therewith from above and the lifting head in abutment with the stack of flats from below. It is also urged into contact therewith by the stack lifting device being positioned at the spin level within the housing.

In the preferred configuration the drive device will include a spinner motor which rotationally drives the drive engagement device when necessary as well as a motor braking device to facilitate rapid slowing of the rotational movement of the stack of flats after the spin drying is concluded thereby facilitating prompt exiting thereof from the housing and speeding up the overall time required for the spin drying process. The braking device also aligns the stack of flats with the conveyor prior to replacement thereon after conclusion of spin drying. A stack conveying device is also preferably included for transporting stacks of trays into and out of the drying station at the base level.

This apparatus in operation is useful for spin drying of flats such as egg trays in accordance with a new improved novel process. This process includes the transporting by conveying of a stack of flats for entry into the spin drying housing at the base level. The stack of flats is then engaged from below by a rotatable lifting head. It is lifted upwardly by lifting the lifting head and the stack of flats engaged thereabove into abutting engagement with a drive engagement device positioned thereabove at the spin level above the base level within the drying housing. The drive engagement device is then registered with respect to the stack of flats to facilitate simultaneous rotation thereof responsive to rotation of the drive engagement device. The registering of the drive engagement device with respect to the stack of flats is performed preferably by including a plurality of alignment pins arranged in a pin array extending downwardly therefrom in position peripherally about the stack of flats abutting the drive engagement device from beneath. In this manner simultaneous rotation thereof with the drive engagement device will be achieved wherein the pin array includes two pins positioned peripherally at each of the four corners to facilitate engagement of the drive engagement device with respect to the rectangular stack of flats.

Thereafter the drive engagement device is rotationally driven to cause simultaneous rotational movement of the stack of flats for spin. drying thereof and cause simultaneous driving of the lifting head wherein the axis of rotation of the rotatable lifting head and the axis of rotation of the drive engagement device are parallel and vertically coincident with respect to one another. In this manner spin drying of the stack of flats held therebetween will be significantly facilitated. The rotational driving of the drive engagement device will also include a first rotational driving of the drive engagement device and stack of flats engaged therebeneath for drying thereof. Thereafter the drive engagement device and the stack of flats therebeneath will be subject to braking to rapidly cease rotational movement and align the stack of flats after spin drying with the conveying means located therebelow. Preferably thereafter there will be hesitation for a predetermined time period after braking for the purpose of allowing cleansing solution to drain from the stack of flats from areas therewithin which tend to accumulate liquid during spin drying. Thereafter a second rotational driving will be initiated of the driving engagement device and the stack of flats engages therebeneath to facilitate further drying of the stack of flats. The lifting head will then be moved downwardly with the stack of flats thereabove to release the stack of flats at the base level and allow the lifting head to move downwardly to the retracted position. The stack of flats will then be exit conveyed at the base level from the spin drying housing.

It should be appreciated that the apparatus of the present invention can be utilized in multiple immediately adjacently placed lines. For example the process and apparatus of the present invention can be utilized for spin drying of stacks of flats in a single feed line however it has been found more efficient to operate as many as two, three, four or even more lines immediately adjacent to one another for high speed drying of stacks of flats within a relatively small area which greatly facilitates monitoring of the equipment and high speed spin drying of the flats. It is also possible that the spinning of the flats which is defined above to occur twice could occur only once or could occur more than two times depending upon the tendency of the particular shape of flats to define capture spots which are areas that tend to accumulate liquid during spin drying.

It should be appreciated that the apparatus of the present invention is designed to be positioned immediately adjacent to a washer and preferably downstream therefrom. These washers for flats such as egg trays normally wash the flats when oriented singly upon a conveyor. The flats then need to be stacked to facilitate and significantly enhance the speed of spin drying thereof.

In operation of the apparatus of the present invention it is important to assure that a stack is not conveyed into the spin drying housing until after the stack which is currently being spin dried has exited therefrom. As such the present invention preferably includes a stack exit sensor positioned immediately adjacent the conveyor immediately downstream from the spin drying housing for the purpose of indicating that the housing no longer contains a stack of flats therein. This stack exit sensor is coordinated with a stack holding means adjacent the conveyor immediately upstream of the spin drying housing. This stack holding means is operative to stop the conveying of a stack of flats until an indication is rendered by the stack exit sensor that the stack of flats currently in the spin dryer has exited.

It is an object of the present invention to provide an apparatus for spin drying a stack of flats which is particularly usable for spin drying hydrophobic egg holding trays which can be efficiently operated in as many as four or more immediately adjacent washing and drying lines for increasing maintenance capability and minimizing the use of floor space.

It is an object of the present invention to provide an apparatus for spin drying a stack of flats which is particularly usable for spin drying hydrophobic egg holding trays which is particularly usable for removing water and cleaning solution from flats immediately after washing thereof.

It is an object of the present invention to provide an apparatus for spin drying a stack of flats which is particularly usable for spin drying hydrophobic egg holding trays which provides a very high speed process for drying of trays since multiple trays in a stack are spun simultaneously.

It is an object of the present invention to provide an apparatus for spin drying a stack of flats which is particularly usable for spin drying hydrophobic egg holding trays which can be utilized with any type of device immediately upstream therefrom for forming the flats into vertically extending stacks.

It is an object of the present invention to provide an apparatus for spin drying a stack of flats which is particularly usable for spin drying hydrophobic egg holding trays which provides a fail safe method for preventing the movement of a stack of flats into the spin drying housing if a stack of flats is already present therewithin.

It is an object of the present invention to provide an apparatus for spin drying a stack of flats which is particularly usable for spin drying hydrophobic egg holding trays wherein the stack of flats is lifted upwardly by a rotatable lifting means into registration and engagement with a spinner plate thereabove wherein the spinner plate is driven to facilitate spin drying of the stack of flats at an elevated position within the housing.

It is an object of the present invention to provide an apparatus for spin drying a stack of flats which is particularly usable for spin drying hydrophobic egg holding trays wherein a slotted wall of transparent flexible material is positioned about the housing to minimize the exiting of any liquid expelled during spin drying from exiting the housing.

It is an object of the present invention to provide an apparatus for spin drying a stack of flats which is particularly usable for spin drying hydrophobic egg holding trays wherein the vertical lifting means for moving of the stack of flats upwardly into engagement with the spinner plate thereabove is powered by a pneumatic cylinder means.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
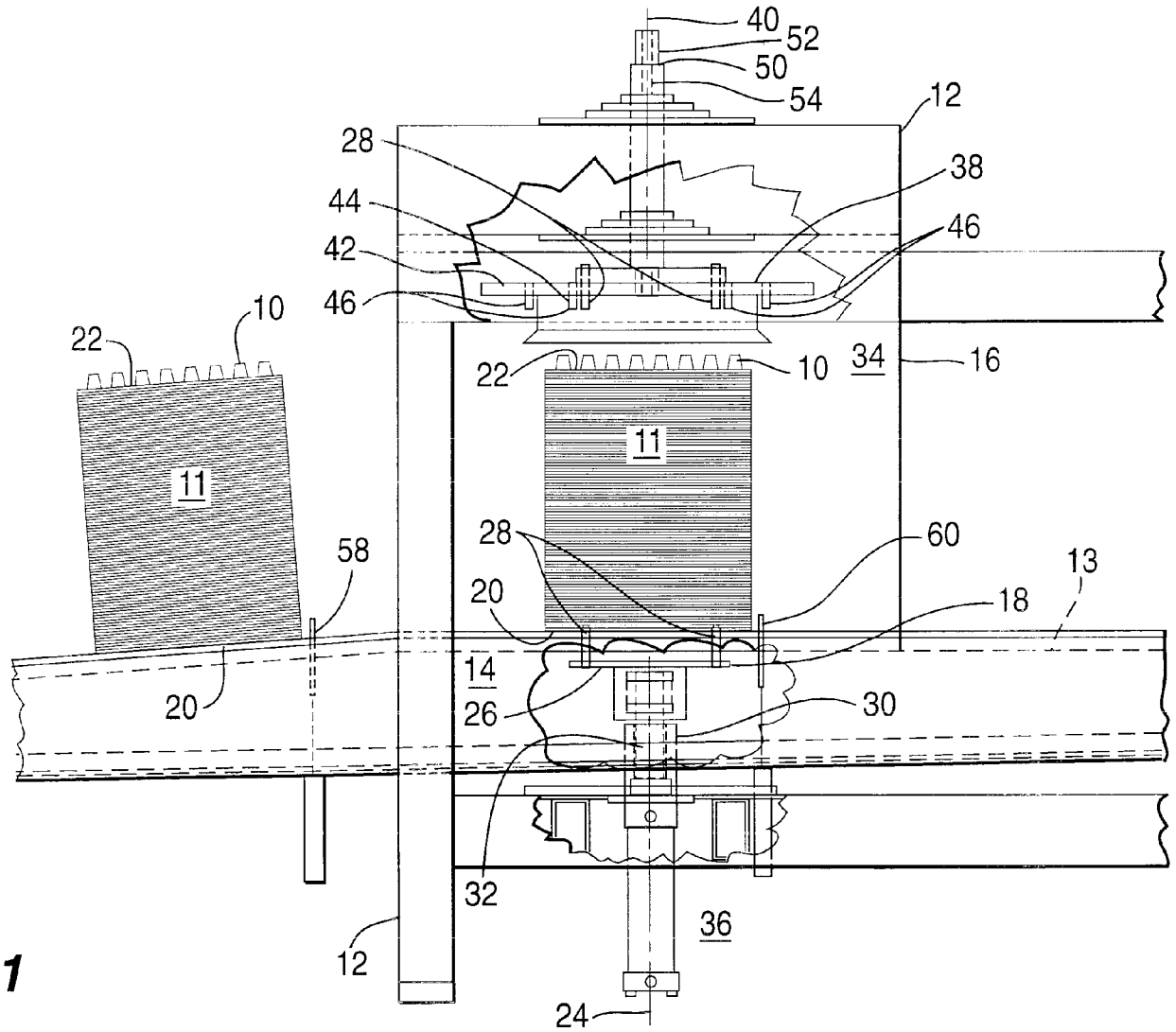
FIG. 1 is a side schematic illustration of an embodiment of the drying apparatus of the present invention.

The present invention provides an apparatus particularly usable for the spin drying of a stack 11 of flats 10 positioned within a housing 12. A transporting means 13 such as a conveyor extends through the housing 12 at a base level 14 therewithin. The conveying means 13 is adapted to transport individual stacks of flats 11 into the housing 12 for spin drying thereof and after drying for exiting the housing 12 for further processing thereof.

The housing 12 preferably will include a slotted wall 16 extending therearound of a transparent flexible material such as plastic which will protect against the unwanted expelling of liquids outwardly during spin drying of the stack of flats while at the same time allowing free entry or exit of the stack of flats 11 into and out of the housing 12.

A lifting head 18 is preferably positioned within the housing 12 at a position below the base level 14. Lifting head 18 is rotatable and is vertically movable. Vertical movement of. lifting head 18 is achieved by a stack lifting means 30. The stack lifting means 30 preferably can comprise an extensible pneumatic cylinder 32 which is vertically extendable to urge upward movement of the lifting head 18 upwardly as desired. Lifting by the stack lifting means 30 will cause the lifting head 18 to move upwardly into contact with the undersurface 22 of the stack of flats to facilitate lifting thereof upwardly to the spin level 34 defined within the housing 12 above the base level 14.

The lifting head 18 preferably will include a support plate 26 which preferably includes a plurality of support pins 28 extending vertically therefrom. These support pins 28 will engage the undersurface 22 of the stack of flats 11 to facilitate lifting thereof upwardly to the spin level 34. The lifting head 18 and in particular the support plate 26 and the support pins 28 thereof will be rotatable as well as being capable of being moved vertically by the stack lifting means 30. This rotation of the lifting head.18 will be about a lifting axis of rotation 24.

The stack lifting device 30 will cause the lifting head 18 and in particular the support plate 26 and the support pins 28 thereof to move the stack of flats 11 upwardly to be in abutment with respect to the drive engagement device 38. Drive engagement device 38 preferably is rotatable about a drive axis of rotation 40. Drive engagement device 38 will preferably include a spinner plate 42 along with a registration means 44 extending downwardly therefrom. This registration device 44 is adapted to maintain angular orientation of the stack of flats 11 with respect to the drive engagement device 38 and in particular the spinner plate 42 thereof and in this manner provide simultaneous rotation of the stack of flats 11 and the drive engagement device 38 at all times. When the lifting head 18 is moved upwardly by the stack lifting device 30 it will cause the stack of flats 11 to move upwardly such that the upper surface 22 thereof is brought into engagement with respect to the drive engagement device 38. Thus in this position which is the position for spin drying at the spin level 34 the lower surface 20 of the stack of flats 11 will be engaged with the lifting head 18. At the same time the upper surface 22 of the stack of flats 11 will be in engagement with the drive engagement device 38. These three individual members, namely the drive engagement device 38, the stack of flats 11 and the lifting head 18 will then be capable of simultaneous rotational movement. This movement is an important characteristic of the present invention and the relationship between the two axes of rotation is also an important aspect. In particular the drive axis of rotation 40 of the drive engagement means 38 and the lifting axis of rotation 24 of the lifting head 18 must be vertically aligned with one another and axially coincident. In this manner the rotation of these three parts simultaneously will be achieved in an efficient and balanced manner.

Figure 2:
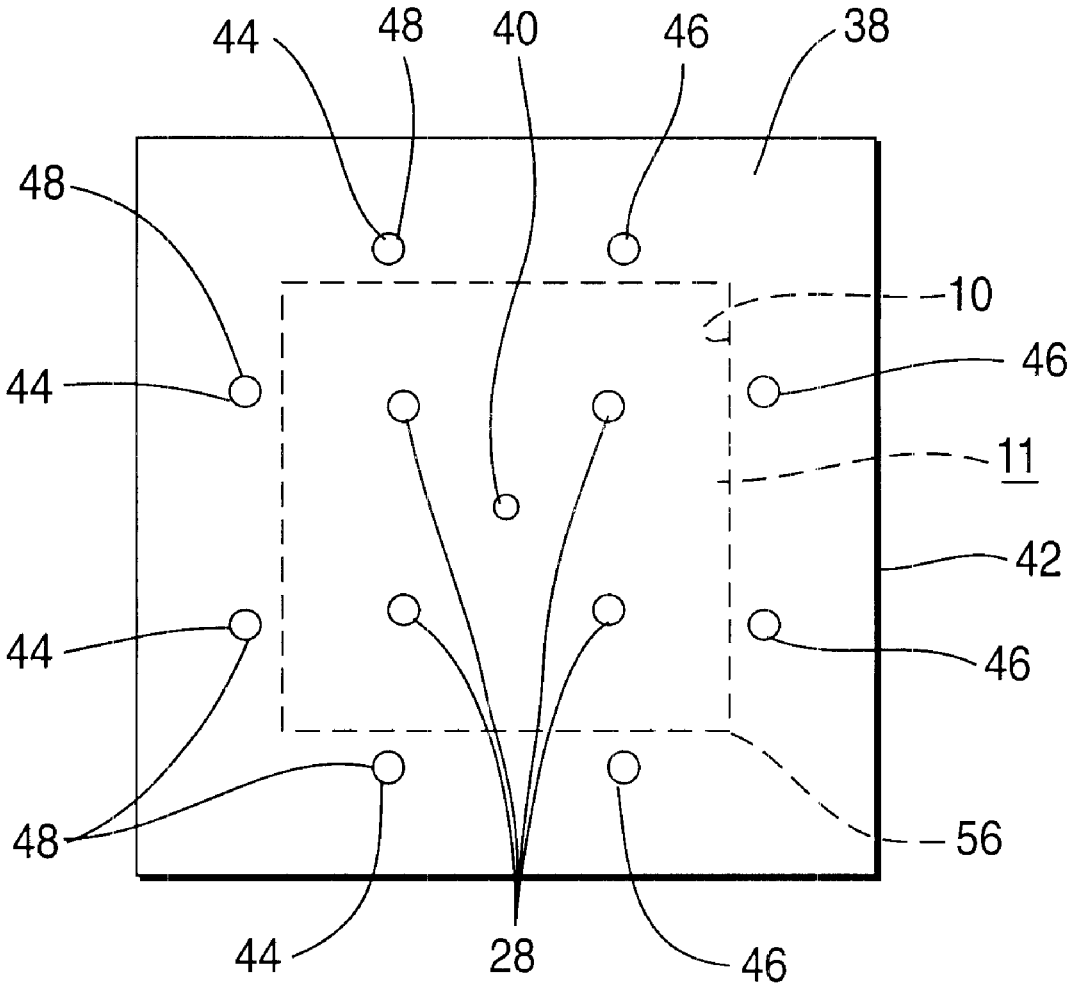
FIG. 2 is a bottom plan view of an embodiment of the spinner plate of the present invention showing the use of a registration means with an array of alignment pins positioned therein.

The alignment pins 46 of the registration means 44 positioned on the spinner plate 42 will preferably be arranged in a pin array 48 as best shown in FIG. 2. This pin array 48 is preferably configured to receive the normal rectangular profile of a stack of flats 11. As can be seen in the drawing of FIG. 2 eight individual pins are positioned with two straddling each rectangular stack corner 56 to thereby assure that the spinner plate 42 and the stack of flats 11 will rotate together at all times.

A drive means 50 is operatively connected to the drive engagement means 38 and in particular the spinner plate 42 for the purpose of rotationally driving thereof. This drive means 50 will preferably include a spinner motor 52 for rotationally driving the spinner plate 42 and will also preferably include a motor braking means 54 operative to rapidly decelerate the rotation of the drive means 50 after de-powering thereof and thereby rapidly decrease the speed of rotation of the spinner plate 42. Motor braking means 54 also operatively aligns. the stack of flats with respect to the transporting or conveying means 13 therebelow prior to replacement thereon after spin drying.

After the spin drying is completed the lifting head 18 will be moved downwardly by downward movement of the stack lifting means 30 such that they both move to the retracted level 36 positioned within the housing 12 below the base level 14 therein.

In operation of the present invention it is important that a stack of flats 11 not be conveyed into the housing 12 at any time when a stack of flats 11 is already located therein either during spinning or pre-spinning or post-spinning portions of the cycle. For this reason a stack exit sensor 60 is positioned adjacent to the transporting conveyor 13 immediately downstream from housing 12. Stack exit sensor 60 will indicate when the stack has exited housing 12. This information will be communicated to a stack holding means 58 positioned adjacent the transporting conveyor 13 immediately upstream of the housing 12 for the purpose of releasing a stack of flats 11 which may be presently held at that location awaiting a signal from the stack exit sensor 60.

The configuration of the present invention provides a line for spin drying. However the present invention encompasses the positioning of multiple lines immediately adjacent to one another of as many as one, four or even more individual lines each immediately adjacent to one another to facilitate monitoring thereof and enhance speed of drying of the flats while at the same time minimizing the use of floor space. One of the unique aspects of the present invention is in the lifting from below used in combination with a rotatable drive head positioned above a stack of flats which includes a registration means for requiring simultaneous rotation of the stack of flats as well as the drive engagement device.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A method for drying a stack of flats comprising:

A. entry transporting of a stack of flats into a spin drying housing at a base level therewithin;

B. engaging of the stack of flats from below with a rotatable lifting head;

C. lifting upwardly of the lifting head and stack of flats engaged thereabove into abutting engagement with a drive engagement device positioned thereabove at a spin level located above the base level within the drying housing;

D. registering the drive engagement device with respect to the stack of flats to facilitate simultaneous rotation thereof responsive to rotation of the drive engagement device;

E. rotationally driving of the drive engagement device to cause simultaneous rotational movement of the stack of flats for spin drying thereof;

F. moving downwardly of the lifting head and the stack of flats thereabove to release the stack of flats at the base level; and G. exit transporting of the stack of flats at the base level from the spin drying housing.

2. A method for drying a stack of flats as defined in claim 1 wherein said entry transporting comprises entry conveying and said exit transporting comprises exit conveying.

3. A method for drying a stack of flats as defined in claim 1 wherein the axis of rotation of rotatable lifting head and the axis of rotation of the drive engagement device are parallel and vertically coincident with respect to one another to facilitate spin drying of the stack of flats held therebetween.

4. A method for drying a stack of flats as defined in claim 1 wherein registering of the drive engagement device with respect to the stack of flats therebelow is performed by a plurality of alignment pins arranged in a pin array extending downwardly therefrom and positioned peripherally around the stack of flats abutting the drive engagement device from beneath to facilitate simultaneous rotation thereof with rotation of the drive engagement device.

5. A method for drying a stack of flats as defined in claim 4 wherein the stack of flats is rectangular and the pin array includes two pins positioned peripherally at each of the four corners thereof to facilitate engagement of the drive engagement device with respect to the rectangular stack of flats.

6. A method for drying a stack of flats as defined in claim 1 further includes providing a transparent slotted wall surrounding the spin drying level of the housing to prevent the expelling of water outwardly therefrom during spin drying of a stack of flats therewithin.

7. A method for drying a stack of flats as defined in claim 1 wherein said rotational driving of the drive engagement device when in engagement with a stack of flats therebeneath causes simultaneous rotation of the stack of flats for drying and simultaneous rotation of the lifting head in engagement with the stack of flats therebeneath.

8. A method for drying a stack of flats as defined in claim 1 wherein said rotational driving of the drive engagement device includes;

A. first rotational driving of the driving engagement device and the stack of flats engaged therebeneath;

B. allowing the driving engagement device and the stack of flats therebeneath to cease rotational movement; and C. initiating a second rotational driving of the driving engagement device and the stack of flats engaged therebeneath to facilitate further drying of the stack of flats.

9. A method for drying a stack of flats as defined in claim 8 wherein said allowing the driving engagement device and the stack of flats therebeneath to cease rotation movement includes braking of the rotational movement of the drive engagement device and the stack of flats therebeneath to decrease the time required for spin drying and to align the stack of flats with respect to the transporting device to facilitate transporting thereof after spin drying.

10. A method for drying a stack of flats as defined in claim 9 further comprising hesitating for a predetermined time period immediately after braking of the rotational movement to allow liquid to drain from the stack of flats from liquid accumulation areas prior to initiating second rotational driving thereof.

11. A method for drying a stack of flats as defined in claim 1 wherein the stack of flats comprises stacks of egg holding trays.

12. A method for drying a stack of flats as defined in claim 1 further including exit sensing of the exit transporting of a stack of flats responsive to exiting thereof from the spin drying housing.

13. A method for drying a stack of flats as defined in claim 12 including delaying of said entry transporting of a stack of flats into the spin drying housing until said exit sensing indicates a stack of flats has exited therefrom.

14. A method for drying a stack of flats comprising:

A. entry transporting by entry conveying of a stack of flats into a spin drying housing at a base level therewithin;

B. engaging of the stack of flats from below with a rotatable lifting head;

C. lifting upwardly of the lifting head and stack of flats engaged thereabove into abutting engagement with a drive engagement device positioned thereabove at a spin level located above the base level within the drying housing;

D. registering the drive engagement device with respect to the stack of flats to facilitate simultaneous rotation thereof responsive to rotation of the drive engagement device;

E. rotationally driving of the drive engagement device to cause simultaneous rotational movement of the stack of flats for spin drying thereof and cause simultaneous driving of the lifting head wherein the axis of rotation of rotatable lifting head and the axis of rotation of the drive engagement device are parallel and vertically coincident with respect to one another to facilitate spin drying of the stack of flats held therebetween, said rotational driving of the drive engagement device further including:

(1) first rotational driving of the driving engagement device and the stack of flats engaged therebeneath;

(2) allowing the driving engagement device and the stack of flats therebeneath to cease rotation movement;

(3) initiating a second rotational driving of the driving engagement device and the stack of flats engaged therebeneath to facilitate further drying of the stack of flats;

F. moving downwardly of the lifting head and the stack of flats thereabove to release the stack of flats at the base level; and G. exit transporting by exit conveying of the stack of flats at the base level from the spin drying housing.

15. A method for drying a stack of flats which are rectangular in shape comprising:

A. entry transporting by entry conveying of a stack of flats into a spin drying housing at a base level therewithin;

B. engaging of the stack of flats from below with a rotatable lifting head;

C. lifting upwardly of the lifting head and stack of flats engaged thereabove into abutting engagement with a drive engagement device positioned thereabove at a spin level located above the base level within the drying housing;

D. registering the drive engagement device with respect to the stack of flats to facilitate simultaneous rotation thereof responsive to rotation of the drive engagement device, said registering of the drive engagement device with respect to the stack of flats therebelow being performed by a plurality of alignment pins arranged in a pin array extending downwardly therefrom and positioned peripherally around the stack of flats abutting the drive engagement device from beneath to facilitate simultaneous rotation thereof with rotation of the drive engagement device wherein the pin array includes two pins positioned peripherally at each of the four corners thereof to facilitate engagement of the drive engagement device with respect to the rectangular stack of flats;

E. rotationally driving of the drive engagement device to cause simultaneous rotational movement of the stack of flats for spin drying thereof and cause simultaneous driving of the lifting head wherein the axis of rotation of rotatable lifting head and the axis of rotation of the drive engagement device are parallel and vertically coincident with respect to one another to facilitate spin drying of the stack of flats held therebetween, said rotational driving of the drive engagement device further including:

(1) first rotational driving of the driving engagement device and the stack of flats engaged therebeneath;

(2) braking the driving engagement device and the stack of flats therebeneath to cease rotational movement thereof and to align the stack of spin dried flats with respect to the transporting device;

(3) hesitating for a predetermined time period immediately after braking of the rotational movement to allow liquid to drain from the stack of flats from liquid accumulation areas;

(4) initiating a second rotational driving of the driving engagement device and the stack of flats engaged therebeneath to facilitate further drying of the stack of flats;

F. moving downwardly of the lifting head and the stack of flats thereabove to release the stack of flats at the base level;

G. exit transporting by exit conveying of the stack of flats at the base level from the spin drying housing; and H. providing a transparent slotted wall surrounding the spin drying level of the housing to prevent the expelling of water outwardly therefrom during spin drying of a stack of flats therewithin.

* * * * *